US008529121B2

(12) United States Patent
Mertenat

(10) Patent No.: US 8,529,121 B2
(45) Date of Patent: Sep. 10, 2013

(54) COLUMN-WHEEL FOR A CHRONOGRAPH, CHRONOGRAPH AND CHRONOGRAPH WATCH INCLUDING SUCH A WHEEL

(75) Inventor: Olivier Mertenat, Solothum (CH)

(73) Assignee: Compagnie des Montres Longines, Fracillion S.A., St-Imier (CH)

( * ) Notice: Subject to any disclaimer, the term of this patent is extended or adjusted under 35 U.S.C. 154(b) by 113 days.

(21) Appl. No.: 13/255,446

(22) PCT Filed: Mar. 11, 2010

(86) PCT No.: PCT/EP2010/053073

§ 371 (c)(1),
(2), (4) Date: Nov. 17, 2011

(87) PCT Pub. No.: WO2010/103060

PCT Pub. Date: Sep. 16, 2010

(65) Prior Publication Data

US 2012/0069717 A1 Mar. 22, 2012

(30) Foreign Application Priority Data

Mar. 12, 2009 (EP) ..... 09155010

(51) Int. Cl.
*G04F 7/08* (2006.01)

(52) U.S. Cl.
USPC ..... 368/101; 368/220

(58) Field of Classification Search
USPC ..... 368/101–106, 220
See application file for complete search history.

(56) References Cited

U.S. PATENT DOCUMENTS

| | | | | |
|---|---|---|---|---|
| 4,922,474 | A | 5/1990 | Groothuis | |
| 5,113,382 | A | 5/1992 | Bron | |
| 6,724,692 | B1 * | 4/2004 | Akahane et al. | 368/204 |
| 2009/0161493 | A1 * | 6/2009 | Wyssbrod | 368/106 |
| 2011/0205854 | A1 * | 8/2011 | Wiederrecht | 368/132 |

FOREIGN PATENT DOCUMENTS

| | | | |
|---|---|---|---|
| CH | 6 505 | A | 11/1893 |
| CH | 189 448 | A | 2/1937 |
| DE | 43 267 | C | 9/1887 |
| DE | 641 948 | C | 2/1937 |
| EP | 0 290 982 | A1 | 11/1988 |
| EP | 0 451 660 | A | 10/1991 |
| FR | 806.906 | A | 12/1936 |

* cited by examiner

*Primary Examiner* — Amy Johnson
*Assistant Examiner* — Matthew Powell
(74) *Attorney, Agent, or Firm* — Sughrue Mion, PLLC

(57) ABSTRACT

The column-wheel (1) for a chronograph includes:

a ratchet (2) provided with a plurality of teeth (3) the shape of which defines the direction of rotation of the column-wheel;

a superstructure coaxial to the wheel and having n>=3 order rotational symmetry, the peripheral part of the superstructure forming n columns (10) parallel to the wheel axis and arranged substantially along the periphery of the ratchet (2), each column including an outer part, the cross-section of which is substantially shaped like a truncated triangle with a base substantially parallel to the circumference of the wheel and a front side (12), called the leading edge, and a back side (13), called the trailing edge, extending from the base towards the interior of the wheel. The column-wheel is characterized in that said cross-section is asymmetrical, a first angle α between the leading edge (12) and the base (14) being smaller than a second angle β between the base and the trailing edge (13).

9 Claims, 7 Drawing Sheets

COLUMN-WHEEL FOR A CHRONOGRAPH, CHRONOGRAPH AND CHRONOGRAPH WATCH INCLUDING SUCH A WHEEL

CROSS REFERENCE TO RELATED APPLICATIONS

This application is a National Stage of International Application No. PCT/EP2010/053073 filed Mar. 11, 2010, claiming priority based on European Patent Application No. 09155010.3 filed Mar. 12, 2009, the contents of all of which are incorporated herein by reference in their entirety.

FIELD OF THE INVENTION

The invention relates to a column-wheel for a chronograph including columns of optimised shape. It also concerns a chronograph control mechanism and a chronograph watch including a column-wheel of this type.

PRIOR ART

It is known to use a column-wheel to control and manage the various chronograph functions in a chronograph watch. The columns of the column-wheel conventionally have a cross-section which is substantially shaped like a truncated triangle (see FIG. 1). This type of shape means that the wheel and columns can be manufactured simply and inexpensively. However, the various levers subject to the action of the columns are sometimes subjected to forces that are too great, thereby increasing levels of friction and wear. Further, when the various chronograph functions are implemented, the level of precision is not always optimal.

SUMMARY OF THE INVENTION

It is an object of the present invention to overcome the aforementioned drawbacks of the prior art by providing a column-wheel allowing better distribution of the forces on the levers and a higher level of precision in controlling the chronograph functions. It achieves this object by providing a column-wheel in accordance with the annexed claim 1.

It will be clear that the "front side" and "back side" of the truncated triangular cross-section are defined in relation to the direction of rotation of the column-wheel.

The features of the invention optimise the general mechanical performances of the levers cooperating with the columns. For example, a reduction in friction, wear and wasted energy is obtained as well as improved precision in the arrangements of parts and resulting functions, etc. Consequently, better control of the chronograph functions is obtained.

One advantage of the present invention is that the geometry of the columns enables the direction of the force vectors necessary for lifting the levers to be precisely defined. This results in a decrease in the forces involved, improved efficiency, a decrease in wear and increased control of the force to be exerted on the "start/stop" control member.

Moreover, according to the present invention, the height of the hub and arms is between 10% and 50% of the height of the columns. In other words, from a certain height, the back part of the columns is released. One advantage of this feature is that it means that the travel of a lever beak can be extended both when it falls and is lifted, provided that the lever is mounted sufficiently high to allow the beak to pass over the arms and hub of the column-wheel.

According to an advantageous embodiment, the base is convex so as to be substantially parallel to the circumference of the column-wheel.

Angle $\alpha$ is advantageously at least 10% and preferably 20% smaller than angle $\beta$. Further, angle $\alpha$ is preferably comprised between 50 and 53 degrees. It will be clear that by selecting a sufficiently salient angle $\alpha(\alpha<53°)$, it is possible to maximise the length of travel of the beak, which may either increase the angle of lift of the levers or increase the length of the lever arms while keeping the same angle of lift. Conversely, if angle $\alpha$ is too salient ($\alpha>50°$), the forces are concentrated on the tip of angle $\alpha$, which may lead to an undesirable increase in wasted energy and in the force necessary to actuate a control member.

The invention also provides a chronograph control mechanism including a column-wheel as previously described and at least one rocking lever whose beak is able to cooperate with the columns of the column-wheel.

The invention further provides a chronograph watch including a column-wheel as described above and at least one rocking lever whose beak is able to cooperate with the columns of the column-wheel. The lever may for example be a coupling lever, a flyback lever or a brake lever.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

Figure 1:
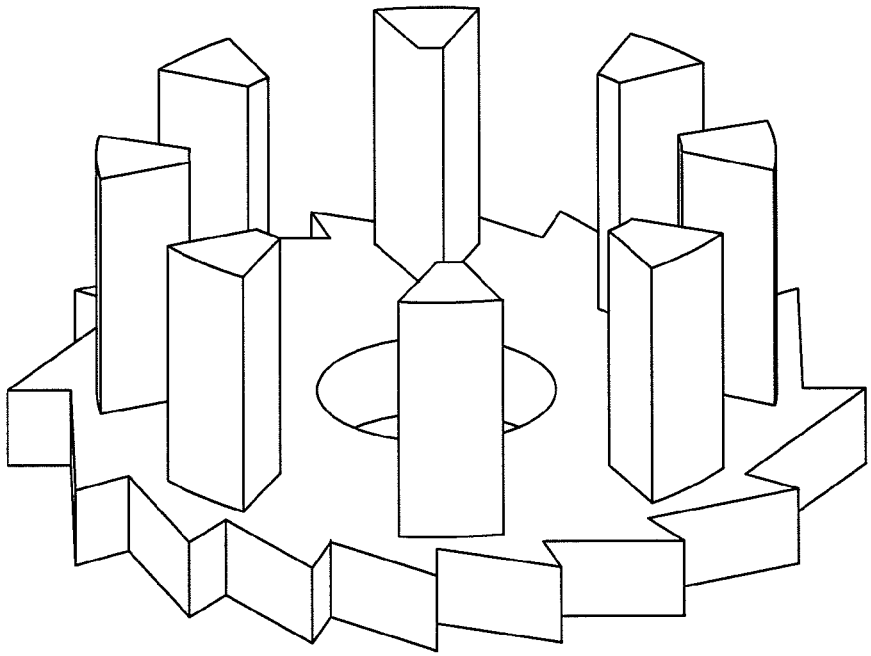
Fig. 1 ( Prior Art )
FIG. 1 is a perspective view of a known type of column-wheel.

FIG. 1 is a perspective view of a known type of column-wheel. The columns are regularly distributed over the periphery of the ratchet. If a transverse cross-section of one column is considered, a symmetrical profile is obtained, substantially shaped like a truncated triangle or trapezium, the large base of which is parallel to the circumference of the column-wheel and turned outwards on the ratchet toothing side. This symmetrical arrangement has advantages as regards the design and especially the fabrication of the columns.

Figure 3:
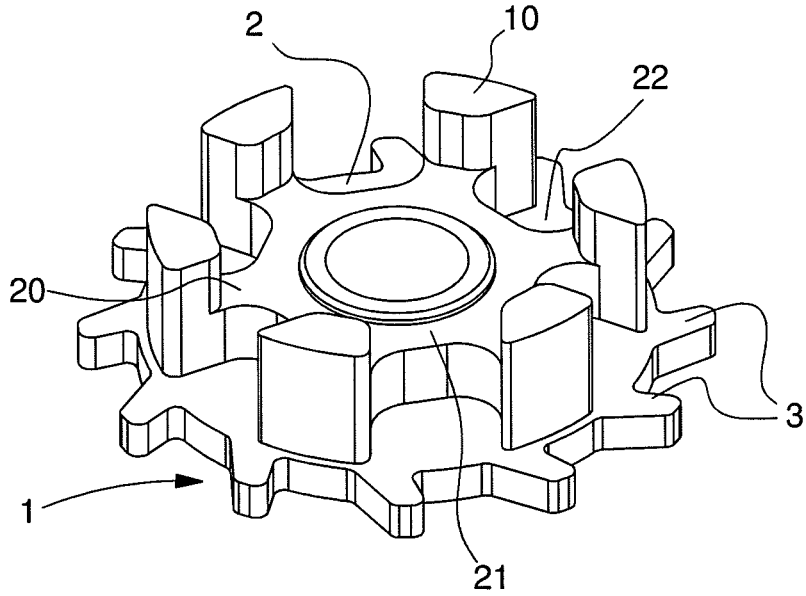
FIG. 3 is a perspective view of the column-wheel of FIG. 2.
Figure 4:
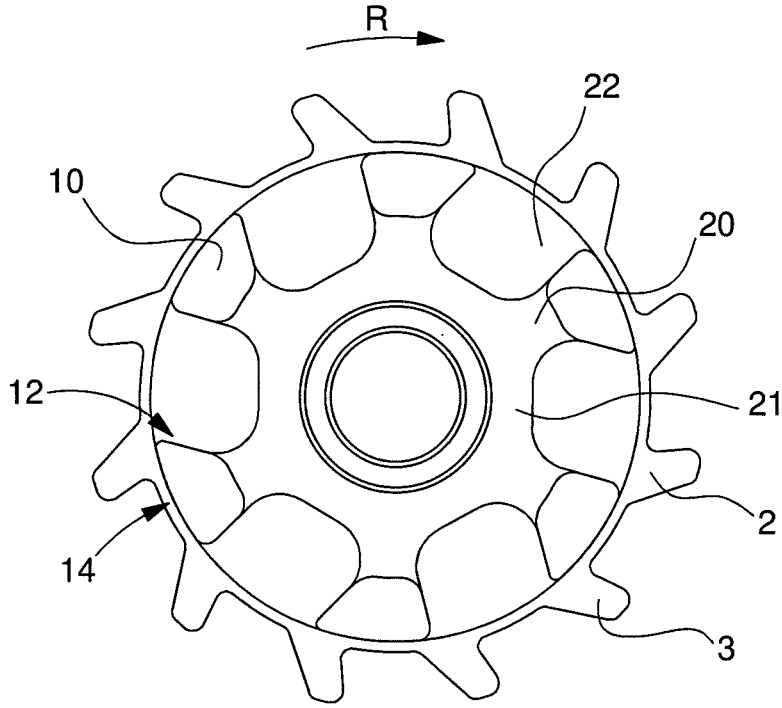
FIG. 4 is a top view of the column-wheel of FIGS. 2 and 3.

FIG. 3 shows a perspective view of a column-wheel 1 according to a particular embodiment of the invention. FIG. 4 is a top view of the same column-wheel. These two Figures clearly show the ratchet 2 provided with teeth 3 symmetrically distributed over the periphery of the ratchet. The centre of ratchet 2 is pierced to provide an assembly element for mounting wheel 1 in a chronograph device. Ratchet 2 is covered by a superstructure formed by a hub 21, arms 20 and columns 10. The six columns 10 are symmetrically arranged on the periphery of ratchet 2 thus providing superstructure 10, 20, 21 with order 6 rotational symmetry. FIG. 4 also shows that ratchet 2 has 12 teeth regularly spaced at 30° from each other. Those skilled in the art will therefore understand that the column-wheel of the present example is a two stroke column-wheel. However, the present invention naturally also equally applies to three stroke column-wheels. The arrow R in FIG. 4 illustrates the direction of rotation of column-wheel 1, i.e. clockwise.

Figure 2:
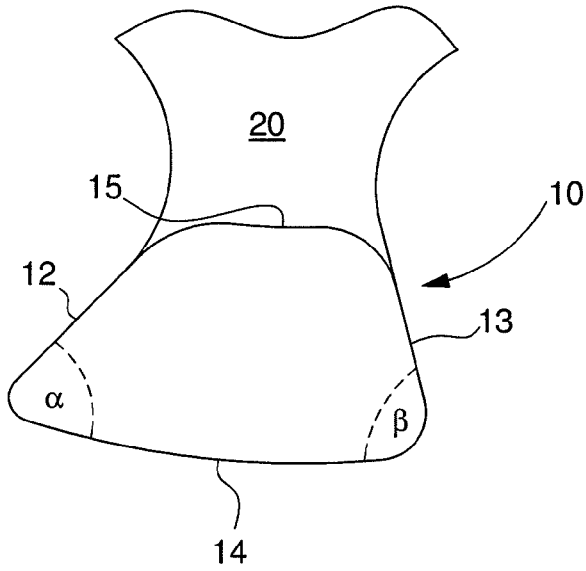
FIG. 2 is a schematic, cross-sectional, top view of a column of a column-wheel according to a particular embodiment of the present invention.

FIG. 2 shows a cross-section of one column 10. It will be observed that the section of the column is generally shaped like a non-isosceles triangle truncated in the apex area. The three sides of the triangle are the large base 14, located in proximity to the edge of ratchet 2, the leading edge 12 and trailing edge 13. The leading edge 12 is referred to as such because it is the first to come into contact with the beak of the lever(s) of the chronograph mechanism when wheel 1 rotates. The trailing edge 13 designates the last face to come into contact with the lever beak before the latter falls into the space between columns 22 and is free again.

The two angles $\alpha$ and $\beta$ adjacent to the large base 14 are rounded. As will be seen below, this feature facilitates the progression of the lever beak cooperating with the column when the chronograph is operating.

Referring to the Figures, it is seen that the truncated triangular or trapezium shape of the cross-section of a column is asymmetrical, with angle $\alpha$ smaller than angle $\beta$, where angle $\alpha$ represents the angle formed between the large base 14 and the leading edge 12, whereas angle $\beta$ represents the angle formed between large base 14 and trailing edge 13. According to this type of arrangement, the leading edge 12 is substantially projected forwards (in direction of rotation R) compared to a conventional symmetrical arrangement as shown in FIG. 1.

In the example illustrated, the value of angles $\alpha$ and $\beta$ is respectively 51.5 degrees and 69.5 degrees. According to various embodiments, angle $\alpha$ may vary, but it is preferably comprised between 50 and 53 degrees. In the present example, angle $\alpha$ is around 26% smaller than angle $\beta$. According to various alternative embodiments, the difference between the two angles is confined to between 23 and 28%.

FIGS. 2, 3 and 4 also clearly show the hub 21 and arms 20 used to reinforce columns 10. Arms 20 extend between the columns and hub 21, which is centred on the axis of the wheel. The arms and the hub rigidify the construction of the wheel in general and the columns in particular. Making the columns more rigid allows operation with a particularly high level of precision. According to the invention, the height of hub 21 and arms 20 is lower than that of columns 10, such that the top part of the columns projects above the rest of the superstructure. The height of the hub and arms will preferably be between 10% and 50% of the height of the columns. The column-wheel according to the invention will preferably be entirely fabricated on a lathe. Uninterrupted fabrication on a lathe gives the part remarkable precision.

Figure 5:
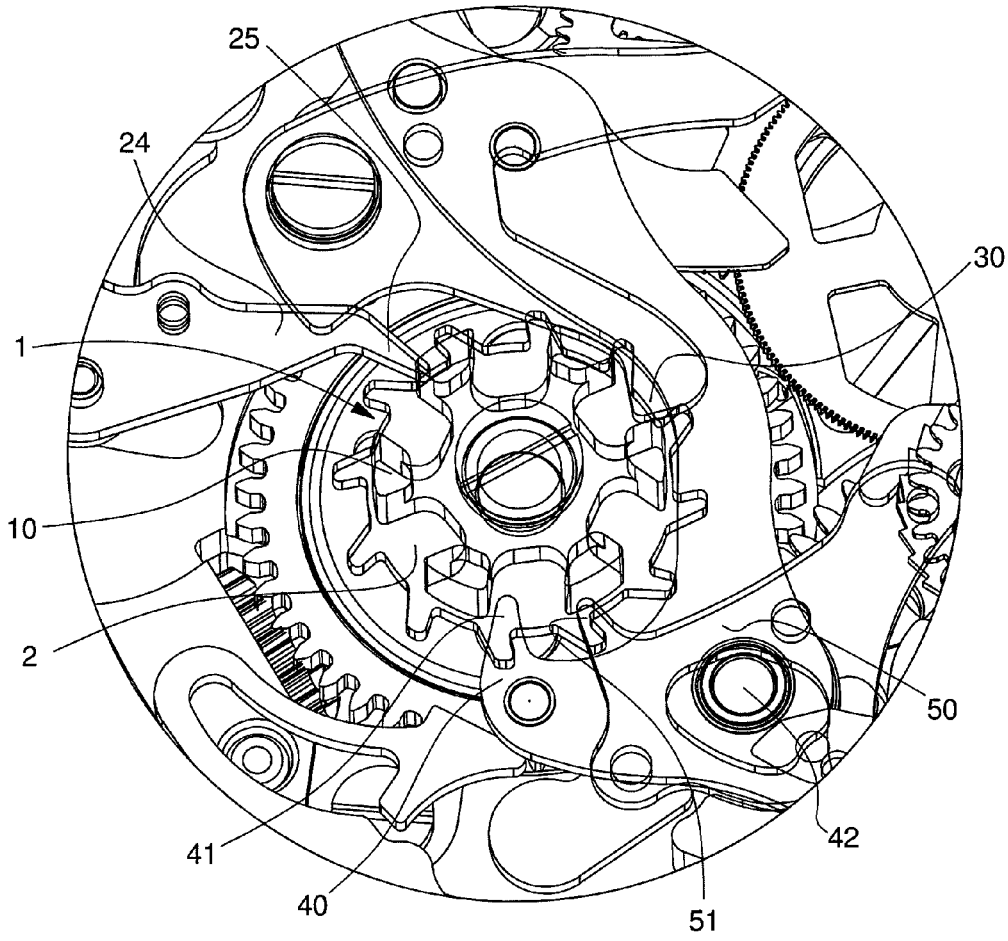
FIG. 5 is a view from the gear side showing an example of a column-wheel integrated in a chronograph watch according to a particular embodiment of the present invention.

FIG. 5 shows an example implementation of a column-wheel 1 according to the invention in a chronograph control mechanism. In addition to the components of the column-wheel which were described in relation to FIGS. 3 and 4, FIG. 5 shows a shuttle or click 24 which is arranged to be actuated by a push-button (not shown) and to act via the beak 25 thereof on a tooth of ratchet 2 so as to move the column-wheel forward through the angular value of one ratchet tooth, a seconds/minute flyback lever 40 pivotably mounted about an axis 42, a coupling lever 50 with a beak 51 and, finally, a brake-lever 30.

Figure 6A:
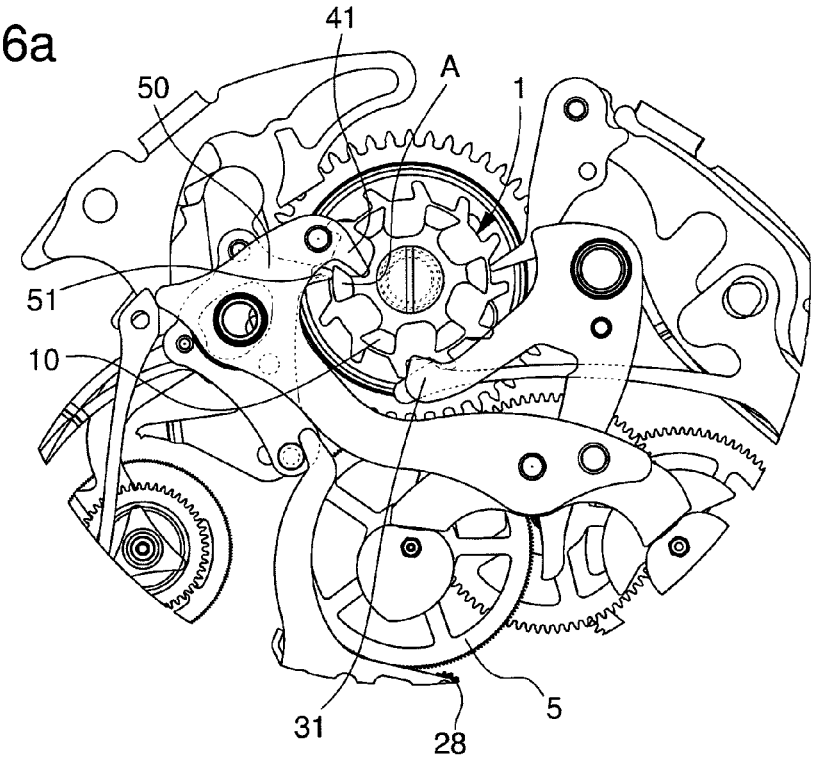
FIGS. 6*a* and 7 to 12 correspond to seven successive "snapshots" showing the "start" function, i.e. the sequence during which the user presses a push-button to move the column-wheel, mounted in a chronograph watch, forward through a 30° step. The forward movement of the column-wheel lifts a flyback lever to release the chronograph heart-pieces and also actuates the coupling lever to start the chronograph hand. The seven "snapshots" are taken every 5°.
Figure 6B:
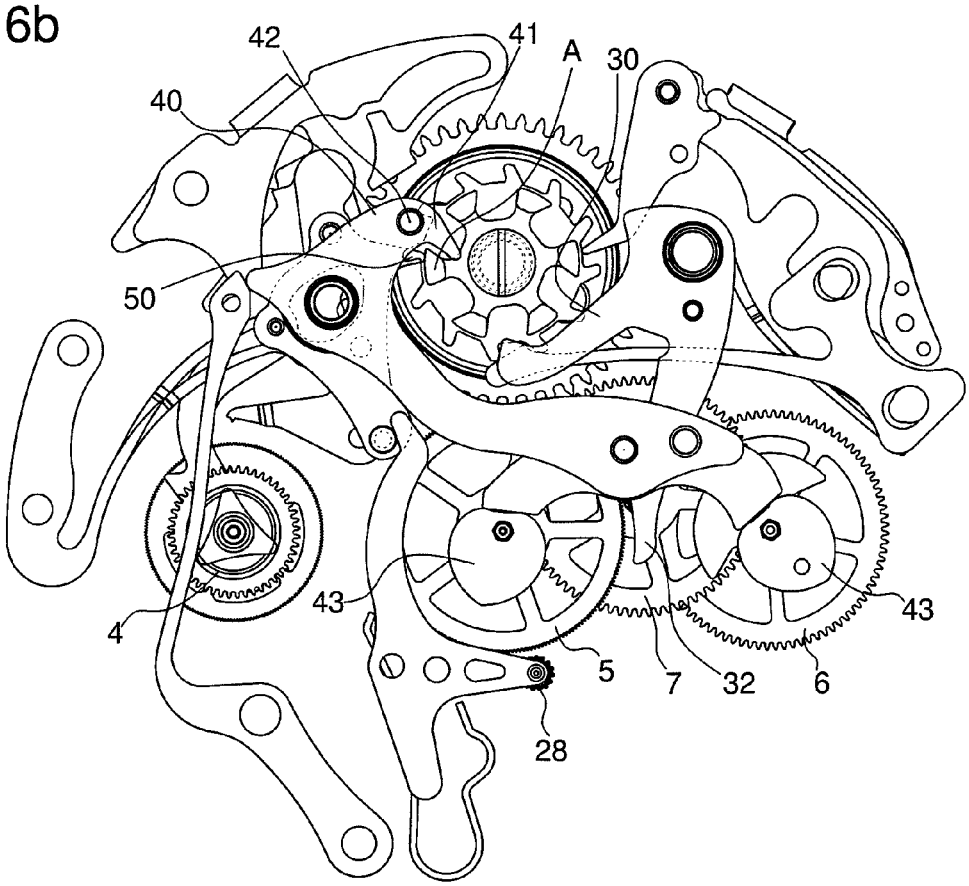
FIG. 6*b* shows the same snapshot as FIG. 6*a* but shows the entire mechanism.

FIGS. 6*a* and 6*b* are top views which correspond to the perspective view of FIG. 5. FIG. 6*b* is more general than FIG. 6*a* so as to show other chronograph elements. These elements are notably a jumper spring 26 whose beak is for cooperating with the teeth of ratchet 2. Further, FIG. 6*b* also shows that the brake lever 30 is integral with a shoe 32 and that it is arranged for cooperating with the column-wheel to alternately brake and release the chronograph wheel (referenced 5). It can be seen that flyback lever 40 is provided with a beak 41 able to cooperate with the columns of the column-wheel. Flyback lever 40 is provided to act on the heart-pieces 43 to operate and control the chronograph reset function. FIG. 6*b* shows flyback lever 40 in a lowered position in which it cooperates with heart-pieces 43. FIG. 6*b* also shows that the lowered position of the flyback lever corresponds to a position of the column-wheel that allows beak 41 of flyback lever lever 40 to fall into the gap between two columns 10. This position of the column-wheel, identified as 0 degrees, acts as a reference. FIGS. 6*a* and 7 to 12 show the change in the position of the wheel, in 5 degree steps, up to a 30 degree position (FIG. 12).

The snapshot shown in FIG. 6*a* corresponds to the 0° position of the column-wheel. In this position, as already mentioned, the flyback lever is lowered against the heart-pieces and flyback lever beak 41 is freely positioned between two columns 10. FIG. 6*a* also shows that in the 0° position, beak 51 of coupling lever 50 is abutting against the outer face of a column 10. The coupling lever is thus lifted, which has the effect of holding an intermediate wheel 28 apart from chronograph wheel 5 and thus of uncoupling wheel 5. It should be specified that flyback lever 40 and brake lever 30 are designed to cooperate such that the brake lever remains lifted independently of the position of the column-wheel as long as the flyback lever is lowered against heart-pieces 43.

Figure 7:
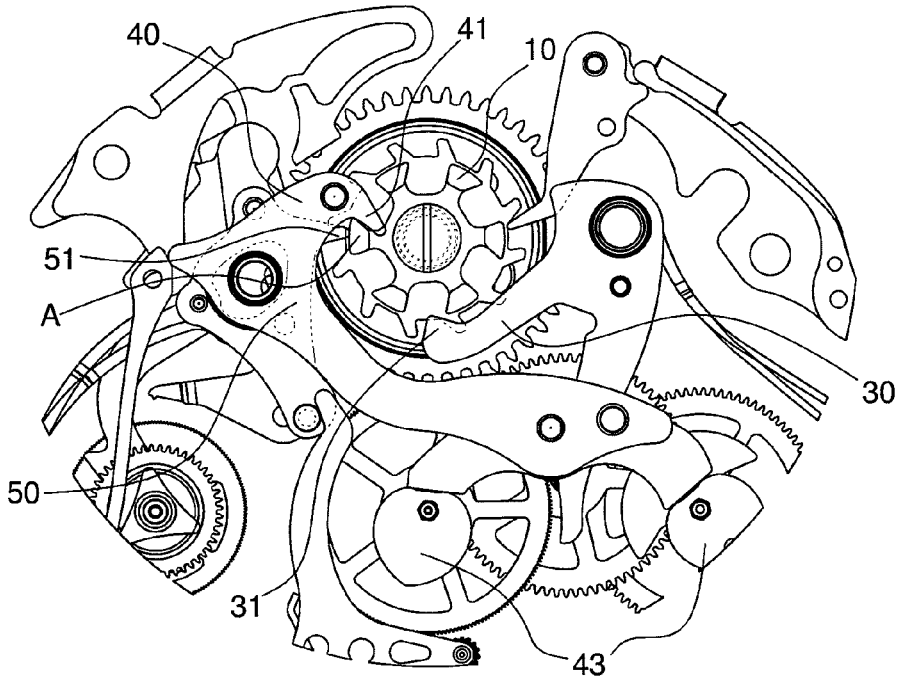

The snapshot shown in FIG. 7 corresponds to the 5° position of the column-wheel. It can be seen that, in this position, flyback lever 40 is still lowered against heart-pieces 43 and brake lever 30 is thus still lifted. However, it is seen that flyback lever beak 41 initiates contact with the leading edge of a column A. The beak 41 is practically tangential to the leading edge, and the tip of the beak is behind the column, above the arm connecting the column to the hub. This position is made possible by the fact that, on the one hand, the height of the hub and arms of the column-wheel is lower than that of the columns and, on the other hand, the flyback lever lever 40 is placed above the other levers, sufficiently high to allow the beak thereof to pass over the arms. It is thus clear that the shape of the columns and superstructure according to the invention allows the forces acting on beak 41 to be distributed as much as possible. Finally, as was the case in FIG. 6*a*, beak 51 of coupling lever 50 is abutting against the outer face of column A.

Figure 8:
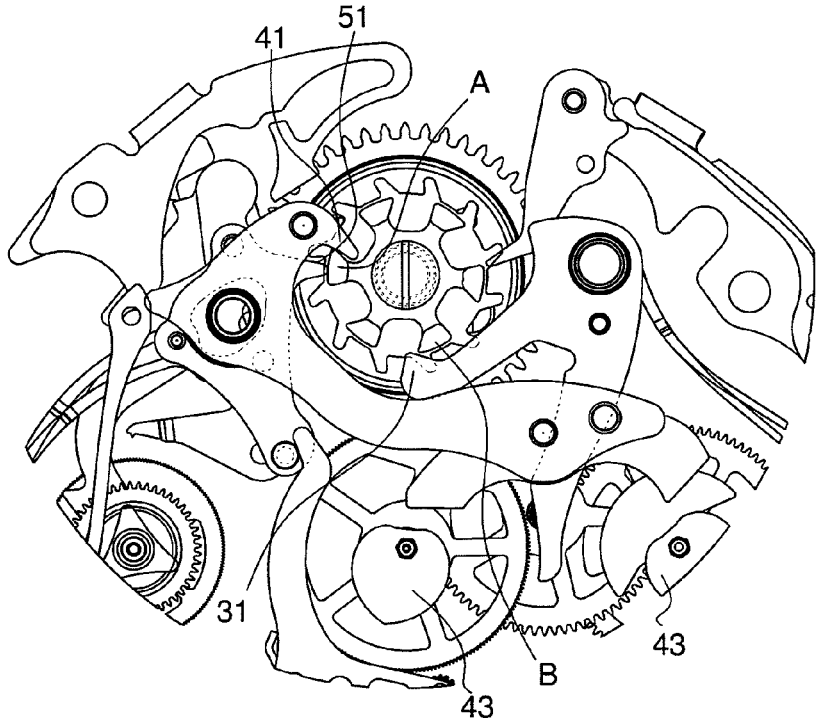

The snapshot shown in FIG. 8 corresponds to the 10° position of the column-wheel. It can be seen that, in this position, flyback lever beak 41 is slightly repulsed by the leading edge of column A and the flyback lever has moved away slightly from heart-pieces 43. It is also seen that the beak of coupling lever 51 is still sliding against the large base of this column. The brake-lever beak 31 is on the point of initiating contact with column B.

Figure 9:
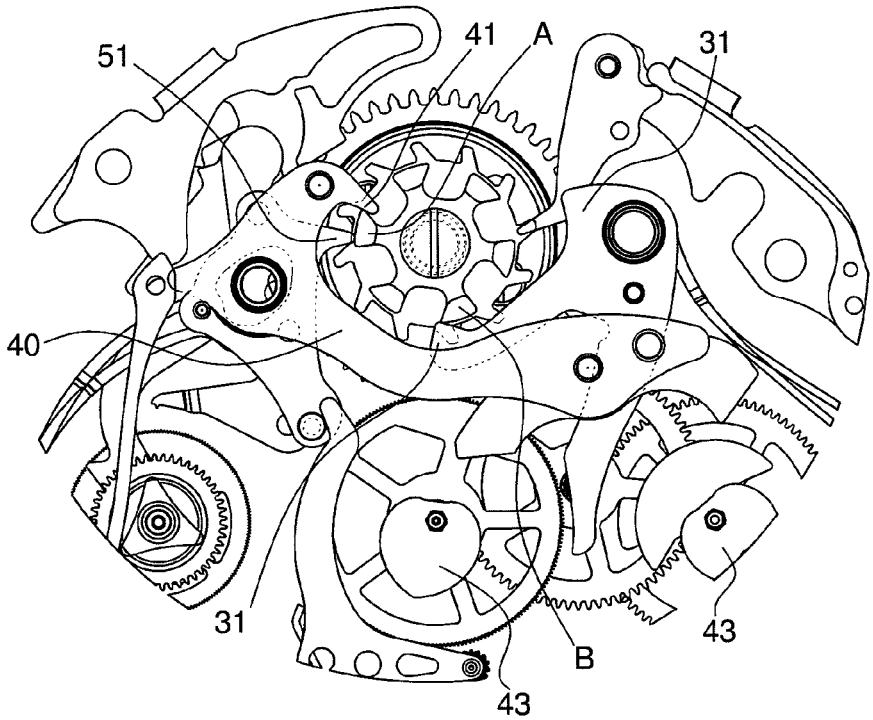

The snapshot shown in FIG. 9 corresponds to the 15° position of the column-wheel. It is seen that, in this position, the lift of flyback lever beak 41 is accentuated owing to the action of column A. The flyback lever has now completely released heart-pieces 43. It is also seen that the coupling lever beak 51 arrives in proximity to the back area of the large base 14 of column A. Further, flyback lever 40 is releasing brake lever 30 but brake lever beak 31 is simultaneously initiating contact with the outer face of column B.

Figure 10:
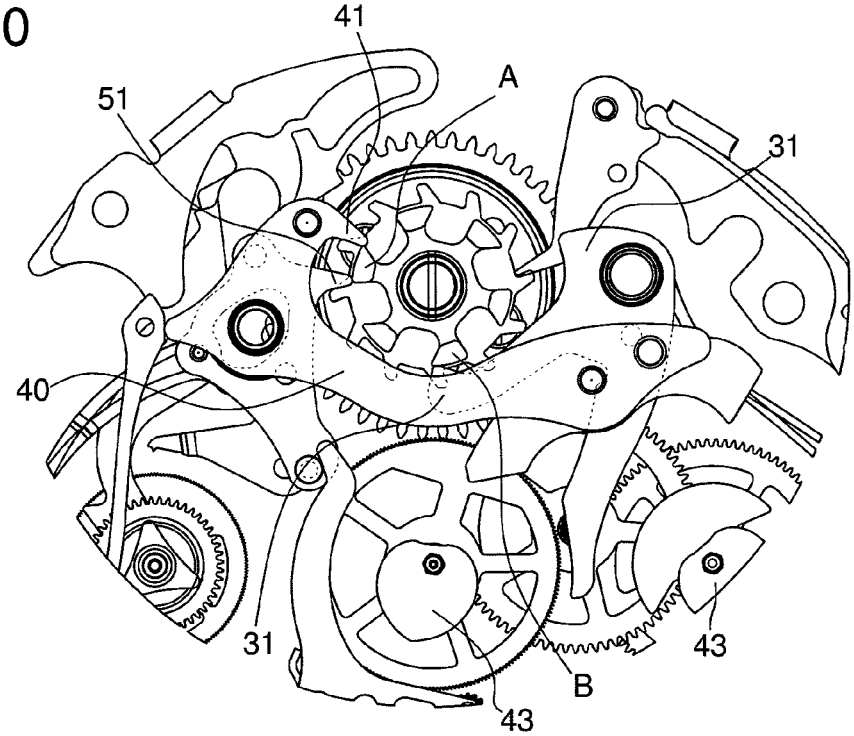

The snapshot shown in FIG. 10 corresponds to the 20° position of the column-wheel. It is seen that, in this position, the lifting of flyback lever beak 41 is almost complete. It is also seen that coupling lever beak 51 is on the point of falling. Further, brake lever beak 31 is now abutting against the large base 14 of column B.

Figure 11:
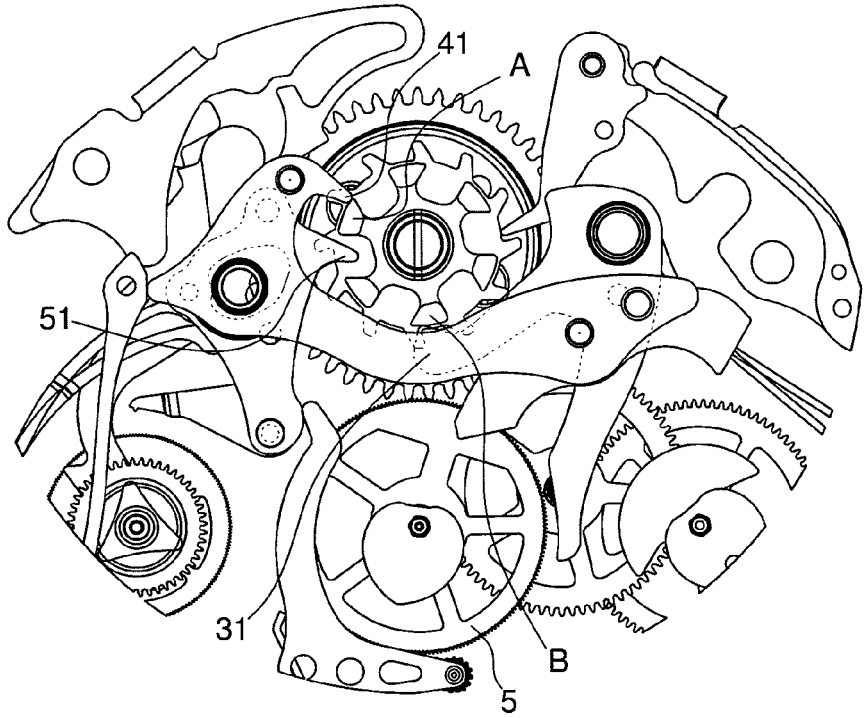
Figure 12:
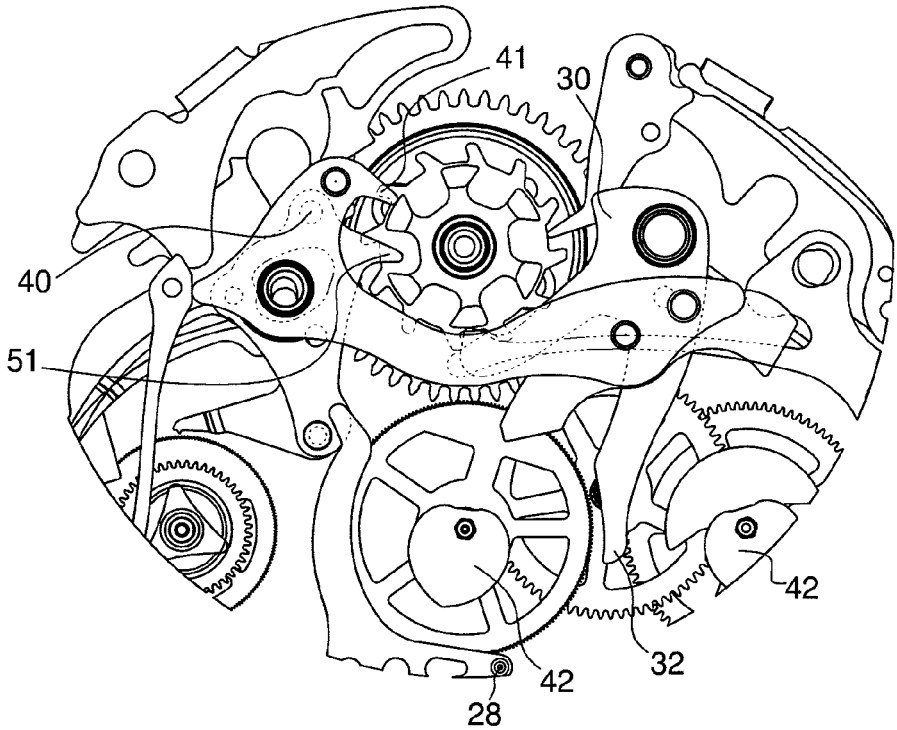

The snapshot shown in FIG. 11 corresponds to the 25° position of the column-wheel. It is seen that, in this position, flyback lever beak 41 is abutting against the large base 14 of column A. The coupling lever beak 51 has fallen between two columns, but the chronograph wheel 5 is not yet coupled. Brake-lever beak 31 is still abutting against the large base 14 of column B.

The snapshot shown in FIG. 12 corresponds to the 30° position of the column-wheel. It is seen that, in this position, the coupling lever beak 51 is still lowered between two columns and intermediate wheel 28 is now meshed with the chronograph wheel which is thus coupled, which corresponds to the start of the chronograph. The brake lever beak 31 remains abutting against the large base 14 of column B.

It is observed from the foregoing and more particularly from FIGS. 7 to 11 that the travel performed by the flyback lever beak along the leading edge of a column is greater than if leading edge 12 and trailing edge 13 were symmetrical. This spreading out of the movement over a greater distance means that the force applied can be reduced. These features optimise the general mechanical features of the levers. For example, a reduction in friction, wear and wasted energy is obtained, as well as improved precision in the arrangements of parts and resulting functions, etc. In particular, levers 30, 40 and 50 are lifted and dropped via asymmetrical columns with a leading edge first in a very precise manner with optimised synchronisation of the respective movements of the parts while the chronograph functions are carried out. Improved control of the chronograph functions is thereby obtained. This geometry of the columns allows the direction of the force vectors necessary for lifting the levers to be precisely defined. A reduction in the forces involved is thus obtained, in addition to improved efficiency, a reduction in wear and increased control of the force to be exerted on the "start/stop" control member.

It will also be clear that various alterations and/or improvements evident to those skilled in the art may be made to the embodiment described herein without departing from the scope of the present invention defined by the annexed claims.

In particular, the invention and the various variants have just been described with respect to a particular example with six columns. However, it is evident to those skilled in the art that the invention may be extended to an embodiment with a different number of columns, particularly with eight columns.

The invention claimed is:

1. A column-wheel for a chronograph including:

a ratchet provided with a plurality of teeth the shape of which defines the direction of rotation of the column-wheel; and a superstructure coaxial to the wheel and having $n \geqq 3$ order rotational symmetry, the peripheral part of the superstructure forming n columns parallel to the wheel axis and arranged substantially along the periphery of the ratchet, each column including an outer part, the cross-section of which is substantially shaped like a truncated triangle with a base substantially parallel to the circumference of the wheel and a front side, called the leading edge, and a back side, called the trailing edge, extending from the base towards the interior of the wheel;

wherein said cross-section is asymmetrical, a first angle $\alpha$ between the leading edge and the base being smaller than a second angle $\beta$ between the base and the trailing edge;

and wherein the superstructure includes a hub connected to the columns by arms so as to reinforce said columns, the height of the hub and the arms being comprised between 10% and 50% of the height of the columns.

2. The column-wheel for a chronograph according to claim 1, wherein the base is substantially rounded and convex.

3. The column-wheel for a chronograph according to claim 1, wherein angle $\alpha$ is at least 10% and preferably 20% smaller than angle $\beta$.

4. The column-wheel for a chronograph according to claim 3, wherein angle $\alpha$ is comprised between 50 degrees and 53 degrees.

5. The chronograph control mechanism including a column-wheel according to claim 1 and at least one rocking lever whose beak cooperates with the columns of the column-wheel.

6. The chronograph control mechanism according to claim 5, wherein the at least one lever is a coupling lever.

7. The chronograph control mechanism according to claim 5 wherein the at least one lever is a flyback lever.

8. The chronograph control mechanism according to 5 wherein the at least one lever is a brake-lever.

9. The chronograph watch including a chronograph control mechanism according to claim 5.

* * * * *